US009239196B2

(12) United States Patent
Ghiani

(10) Patent No.: US 9,239,196 B2
(45) Date of Patent: Jan. 19, 2016

(54) HEAT EXCHANGER

(71) Applicant: Behr GmbH & Co. KG, Stuttgart (DE)

(72) Inventor: Franco Ghiani, Bietigheim-Bissingen (DE)

(73) Assignee: MAHLE International GmbH, Stuttgart (DE)

( * ) Notice: Subject to any disclaimer, the term of this patent is extended or adjusted under 35 U.S.C. 154(b) by 219 days.

(21) Appl. No.: 13/869,523

(22) Filed: Apr. 24, 2013

(65) Prior Publication Data

US 2013/0299147 A1 Nov. 14, 2013

(30) Foreign Application Priority Data

Apr. 26, 2012 (DE) ..... 10 2012 206 982

(51) Int. Cl.
*F28F 9/00* (2006.01)
*F28F 9/02* (2006.01)

(52) U.S. Cl.
CPC ..... *F28F 9/00* (2013.01); *F28F 9/0226* (2013.01); *F28F 2275/122* (2013.01)

(58) Field of Classification Search
CPC ..... F28F 2275/14; F28F 2275/122; F28F 9/0224; F28F 9/0226
USPC ..... 165/173, 158; 29/890.052
See application file for complete search history.

(56) References Cited

U.S. PATENT DOCUMENTS

| | | | | |
|---|---|---|---|---|
| 4,331,201 | A | 5/1982 | Hesse | |
| 5,195,579 | A * | 3/1993 | Buchanan | 165/149 |
| 5,195,582 | A * | 3/1993 | Haase | 165/173 |
| 7,121,329 | B2 * | 10/2006 | Shields et al. | 165/149 |
| 7,341,098 | B2 * | 3/2008 | Brost et al. | 165/149 |
| 2006/0061044 | A1 * | 3/2006 | Merklein et al. | 277/510 |
| 2008/0053645 | A1 | 3/2008 | Hakamata et al. | |
| 2008/0250737 | A1 * | 10/2008 | Hall et al. | 52/223.9 |
| 2008/0308263 | A1 * | 12/2008 | Kolb | 165/149 |
| 2010/0277854 | A1 * | 11/2010 | Yang et al. | 361/679.01 |

FOREIGN PATENT DOCUMENTS

| | | | |
|---|---|---|---|
| DE | 28 16 291 | A1 | 10/1979 |
| DE | 28 52 408 | A1 | 6/1980 |
| DE | 93 17 267 | U1 | 1/1994 |
| DE | 43 38 055 | A1 | 5/1995 |
| DE | 10 2006 002 854 | A1 | 7/2007 |
| DE | 10 2007 040 848 | A1 | 4/2008 |
| FR | 2 751 404 | A1 | 1/1998 |
| JP | 03225197 | A * | 10/1991 |

* cited by examiner

*Primary Examiner* — Tho V Duong
(74) *Attorney, Agent, or Firm* — Muncy, Geissler, Olds & Lowe, P.C.

(57) ABSTRACT

A heat exchanger with a heat exchanger block is disposed between two collecting tanks, whereby the collecting tank have a cover and a tube bottom, The tube bottom has upstanding edge regions. T-shaped tabs are disposed at an upper end of the upstanding edge regions, whereby the collecting tank has a flange rear engageable at least in part by the T-shaped tabs.

6 Claims, 4 Drawing Sheets

HEAT EXCHANGER

This nonprovisional application claims priority under 35 U.S.C. §119(a) to German Patent Application No. 10 2012 206 982.8, which was filed in Germany on Apr. 26, 2012, and which is herein incorporated by reference.

BACKGROUND OF THE INVENTION

1. Field of the Invention

The invention relates to a heat exchanger with a heat exchanger block disposed between two collecting tanks, whereby the collecting tank has a cover and a tube bottom, whereby the tube bottom has upstanding edge regions.

2. Description of the Background Art

Heat exchangers, particularly those used in motor vehicles, normally have a radiator block made of tubes and ribs. The tubes are inserted in a tube bottom and connected to it. A collecting tank is connected to the tube bottom, which normally is made of a metallic material, particularly aluminum.

The collecting tank, which in many cases is made of a plastic, is fixed to the tube bottom by a mechanical connection. To assure a fluid-tight connection between the collecting tank and the tube bottom, a seal is inserted between the tube bottom and collecting tank.

The seal between the collecting tank and tube bottom is compressed by the mechanical connection of the collecting tank with the tube bottom.

The connection between the collecting tank and the tube bottom is exposed to alternating loads by the operation of a heat exchanger. This occurs because of the internal pressure in the heat exchanger. With an increasing operating life of the heat exchanger, there is the risk that the joint between the collecting tank and tube bottom becomes untight. This can be caused, for example, by the deformation of the mechanical connection.

DE 28 52 408 A1, which corresponds to U.S. Pat. No. 4,331,201, discloses a so-called corrugated slotted flanging. The tube bottom in this case has slots in the upstanding edge region. For connection with the collecting tank, the material is pressed over the slots inwardly toward the collecting tank. The inwardly pressed areas thereby engage via a pressed down peripheral flange of the collecting tank, as a result of which the tank is attached. In the case of high loads due to the arising internal pressures, it can happen that the outer wall is pressed outwardly especially along the long sides of the collecting tank and bends the tube bottom or the mechanical retaining elements of the tube bottom, as a result of which there no longer is a sufficient sealing effect.

DE 43 38 055 A1 discloses a similar solution. In addition, hooks of the collecting tank here engage behind the tube bottom from outside. Said hooks are intended to produce an additional stabilizing effect particularly along the long side of the collecting tank.

The insufficient durability in particular of the connection between the tube bottom and collecting tank in the state of the art is disadvantageous.

SUMMARY OF THE INVENTION

It is therefore an object of the invention to provide a mechanical connection between the tube bottom and collecting tank, which brings with it advantages particularly with respect to the durability of the connection.

A heat exchanger with a heat exchanger block disposed between two collecting tanks is advantageous in an embodiment, whereby the collecting tank has a cover and a bottom, with a tube bottom which has upstanding edge regions, whereby T-shaped tabs are disposed at the upper end of the upstanding edge regions, and the cover has a flange rear engageable at least in part by the T-shaped tab.

The flange can have a continuous outer surface against which the inner surfaces of the upstanding edge regions of the tube bottom come to lie.

This is used to position the parts, tube bottom and cover, relative to one another. A simple positionability is useful for an automated manufacturing process.

It is also advantageous if the flange of the cover on its top side has T-shaped grooves, which correspond to the T-shaped tabs of the tube bottom.

As a result, the T-shaped tabs can engage advantageously in the T-shaped grooves of the cover.

In another embodiment, it is advantageous if the T-shaped grooves of the flange have a bottom surface which is disposed at an angle, preferably in the range of 90° to 180°, thereby preferably in a range of 90° to 120°, to the continuous outer surface of the flange.

The T-shaped grooves of the flange can be spaced apart by ribs running on the outer surface of the cover.

It is likewise advantageous if upward projections are disposed on the top side of the flange, whereby the T-shaped tabs can be bent in the flange of the cover so that the projections are rear engageable by the long legs of the T-shaped tabs.

A self-locking of the connection can be achieved by the arrangement of the bottom surface to the outer surface at an angle as described above as well as the additional projections, which are rear engageable by the T-shaped tabs.

In addition, a peripheral seal can be disposed between the tube bottom and the cover.

The seal increases the tightness of the collecting tank. The cover can be mounted advantageously on the tube bottom so that the inserted seal experiences an initial load which in addition increases the tightness.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
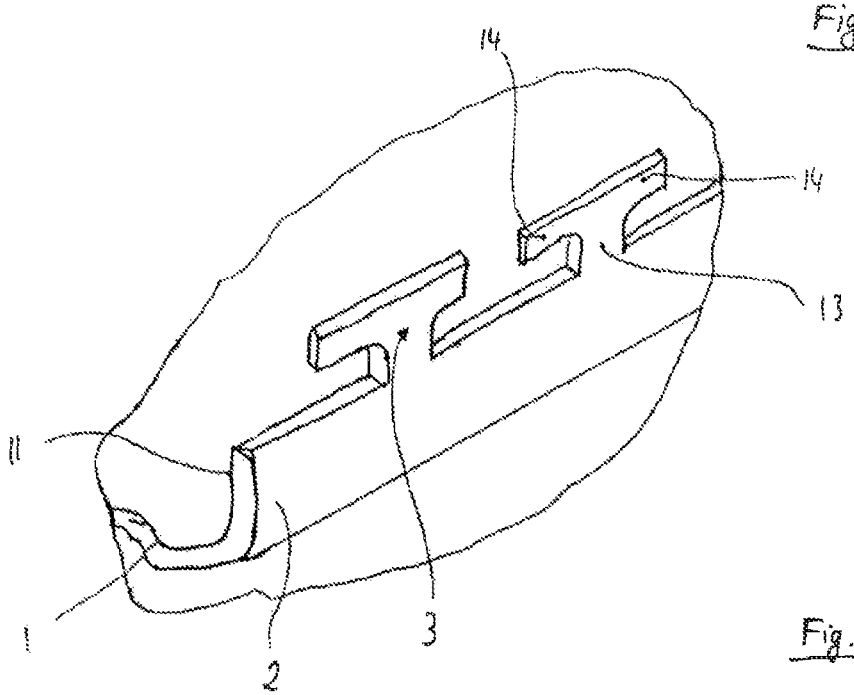
FIG. 1 shows a perspective view of the upstanding edge region of a tube bottom.

FIG. 1 shows a perspective partial view of a tube bottom 1. Shown in particular are upstanding edge region 2 of tube bottom 1 and T-shaped tabs 3 provided on the upper edge of upstanding edge region 2. Inner surfaces 11 of upstanding edge region 2 is used as the contact area for flange 9 of cover 17, which is later inserted in tube bottom 1.

T-shaped tabs 3, which are arranged in the upper area of upstanding edge region 2, are used for the mechanical fixation of cover 17 inserted later into tube bottom 1. To this end, T-shaped tabs 3 are bent inward after insertion of cover 17, so that they engage at least partially behind flange 9 of cover 17. Cover 17 and its flange 9 are shown in the following figures.

T-shaped tabs 3 can include substantially the short leg 13 and two long legs 14. The short leg 13 in this case runs in the vertical direction and each long leg 14 in the horizontal direction, so that a T-shape is formed by the three legs 13, 14.

Figure 2:
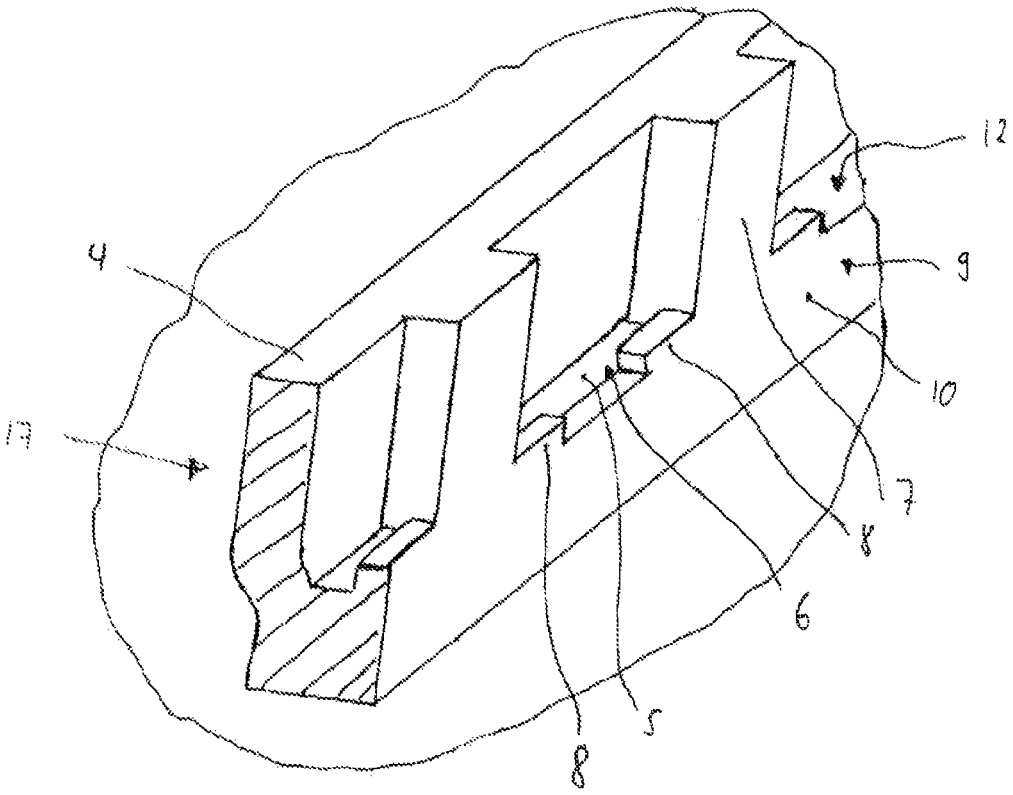
FIG. 2 shows a perspective partial view of a cover of the invention.

FIG. 2 shows a perspective partial section of the base of a cover 17. The base of cover 17 has a peripheral flange 9 in the lower area. Said flange in turn has an outer surface 10. Said outer surface 10 is used as the contact area for inner surface 11 of upstanding edge region 2 of tube bottom 1, as was illustrated in FIG. 1.

Cover 17 has T-shaped grooves 6 on top side 12 of flange 9. Said T-shaped grooves 6 are spaced apart by reinforcing ribs 7 running on the outside on cover 17.

T-shaped tabs 3 of the tube bottom engage in T-shaped grooves 6 of cover 17, which are disposed on top side 12 of peripheral flange 9. For this purpose, cover 17 is inserted in tube bottom 1 from above. Next, T-shaped tabs 3 are deformed inwardly mechanically, so that they engage with an accurate fit in T-shaped grooves 6 of cover 17.

Furthermore, projections 8, which are engaged from the back by long legs 14 of T-shaped tabs 3, are disposed on the top side 12 of flange 9. Projections 8 close T-shaped grooves 6 outwardly and prevent loosening of T-shaped tabs 3 from flange 9 of cover 17.

T-shaped groove 6 has a bottom surface 5, which represents the lower boundary of the groove. Said bottom surface 5 can be disposed either at a right angle to outer surface 9 or also at a larger angle. More details on this aspect are provided in FIG. 5.

Figure 3:
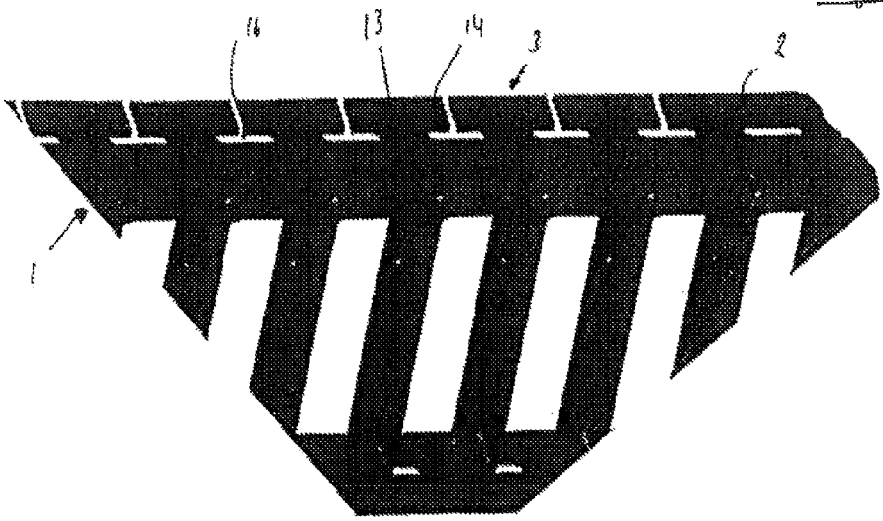
FIG. 3 shows a perspective partial view of a tube bottom of the invention.

FIG. 3 shows a perspective partial view of another tube bottom of the invention. FIG. 3 therefore shows an alternative embodiment of tube bottom 1. In comparison with the tube bottom shown in FIG. 1, here the geometry of T-shaped tabs 3 differs from the T-shaped tabs shown in FIG. 1. The short leg 13 of T-shaped tabs 3 is much shorter in the exemplary embodiment shown in FIG. 3. The two long legs 14 of T-shaped tabs have a greater width in the FIG. 3.

Figure 4:
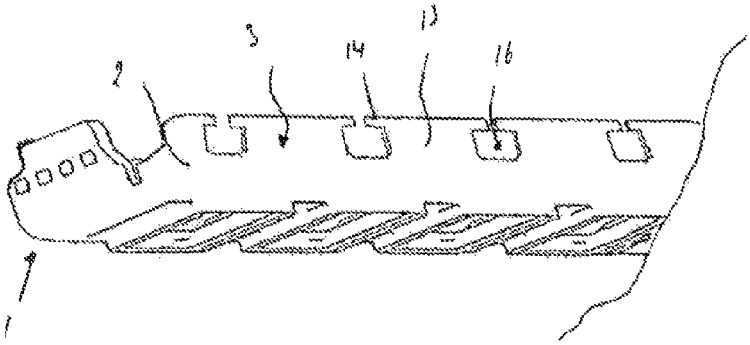
FIG. 4 shows a perspective partial view of a tube bottom of the invention.

FIG. 4 also shows another alternative embodiment of a tube bottom 1. Similar to FIG. 3, FIG. 4 also shows a different geometry for T-shaped tabs 3.

It is also evident from FIGS. 3 and 4 how the T-shaped tabs can be expediently produced on the upstanding edge region 2 of tube bottom 1. It is expedient in this case to punch out, for example, cutouts 16, which are disposed between T-shaped tabs 3, from upstanding edge region 2 of tube bottom 1.

Further details on the additional geometric properties of the tube bottom, such as, for instance, passages for receiving tubes, will not be discussed at this point, because this is not essential to the invention.

Figure 5:
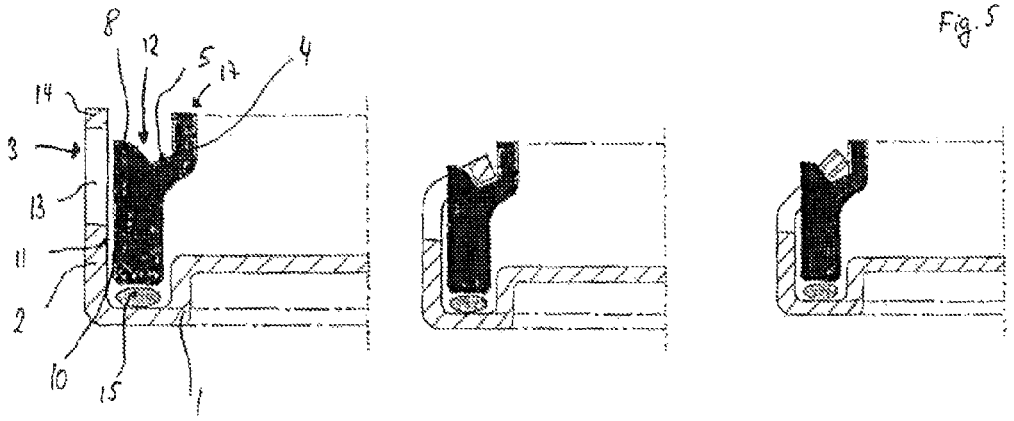
FIG. 5 shows a section through the cover placed in the tube bottom in different phases of the connection process.

FIG. 5 shows a sequence of three different states during the connection process of cover 17 with tube bottom 1.

Three states are shown from left to right, whereby T-shaped tab 3 is always bent further inwardly until it has reached its end position in the right illustration in FIG. 5. A seal 15 is placed in a peripheral channel of tube bottom 1 to connect cover 17 with tube bottom 1. Next cover 17 is inserted in tube bottom 1. Interior surface 11 of upstanding edge region 2 of tube bottom 1 thus comes into contact with outer surface 10 of flange 9 of cover 17.

Projections 8, which are arranged on top side 12 of flange 9, can be readily seen in the sectional view of FIG. 5. These are dimensioned so that they can be engaged from the back by T-shaped tabs 3 of tube bottom 1.

Force is now applied from the outside on T-shaped tab 3 to mechanically connect cover 17 with tube bottom 1. As a result, primarily short leg 13 of T-shaped tab 3 bends and long leg 14 of T-shaped tab 3 engages behind projection 8 of cover 17.

It is readily evident in FIG. 5 that bottom area 5 of T-shaped groove 6, which is inserted in flange 9 of cover 17, is disposed at an angle greater than 90° to outer surface 10 of flange 9.

The top surface of projection 8 runs inwardly from outer surface 10 of flange 9 sloping downward to bottom surface 5 of the T-shaped groove. The surface of projection 8 and bottom surface 5 of the T-shaped groove are thus disposed at an angle to one another.

It is achieved in this way that T-shaped tabs 3, which are bent over flange 9 of cover 17, are fixed self-locking in their seat.

It can happen due to pressures now arising in the interior of the heat exchanger that cover 17 experiences upwardly or outwardly directed forces. Regardless of the direction of this force on cover 17, the connection between tube bottom 1 and collecting tank 4 is always configured so that T-shaped tabs 3 are pulled outward or upward more strongly into the seat of T-shaped groove region 6 of cover 17 due to the occurrence of an internal force. As a result, a self-locking of the mechanical connection is achieved.

Figure 6:
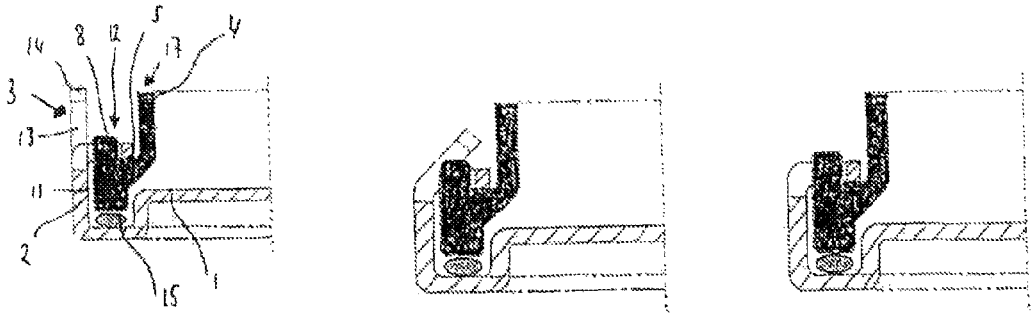
FIG. 6 shows a section through the cover placed in the tube bottom in different phases of the connection process.

FIG. 6, similar to FIG. 5, shows a section through tube bottom 1 and a cover 17 and thereby a connection process between tube bottom 1 and cover 4 proceeding from left to right.

In contrast to the illustrations shown in FIG. 5, projection 8, which is arranged on the top side 12 of flange 9, now has a rectangular cross section. Likewise different from FIG. 5, bottom surface 5 of T-shaped groove region 6 is now disposed at a right angle to outer surface 10 of flange 9.

In this configuration as well, T-shaped tabs 3 are pressed inwardly, so that long legs 14 engage behind projection 8. Essentially short leg 13 of the T-shaped tab is also bent here as well.

As in FIG. 5 as well, the mechanical connection is self-locking in the manner shown here. T-shaped tabs 3 bent forward are pulled only more strongly into their seat in T-shaped grooves 6 of cover 17 due to the arising forces resulting from the internal pressure in a heat exchanger.

Figure 7:
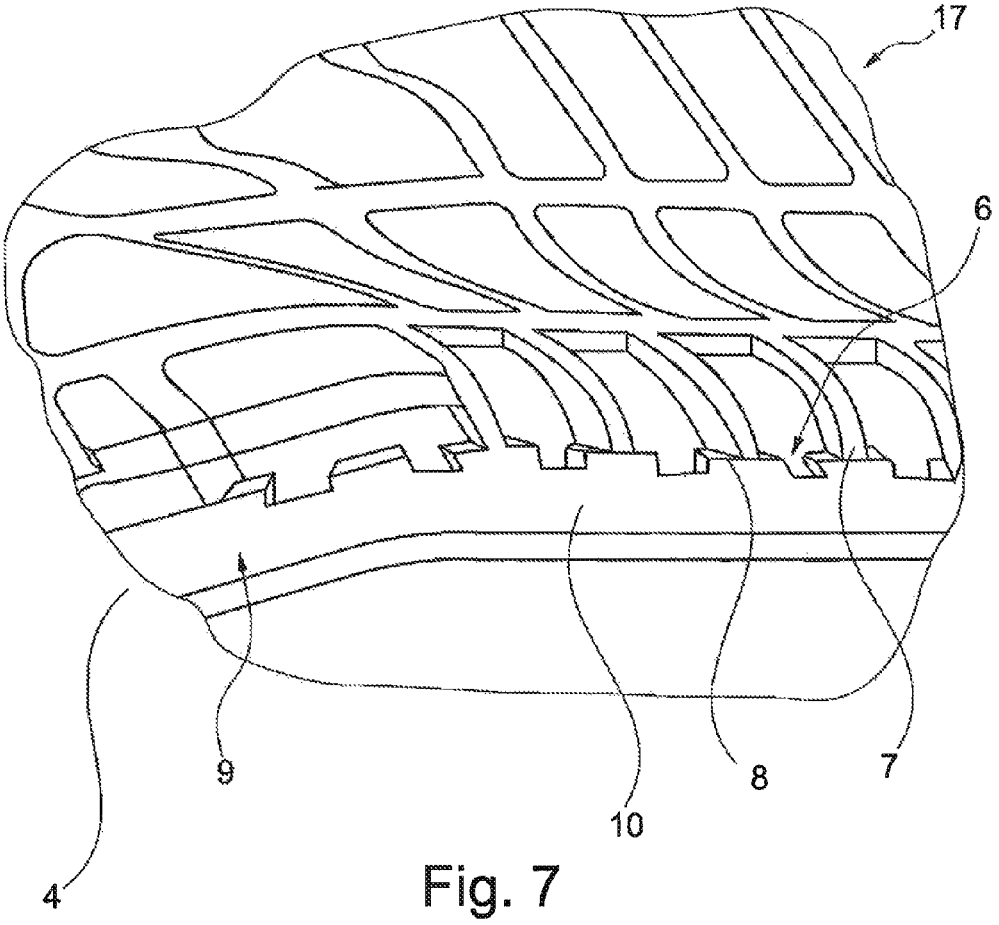
FIG. 7 shows a perspective partial view of a cover of the invention.

FIG. 7 shows a perspective partial view of a cover 17. Peripheral flange 9 and outer surface 10 of peripheral flange 9 are readily evident here. Cover 17 shown in FIG. 7 has reinforcing ribs 7 on its outer surface, which space T-shaped grooves 6 apart from one another.

In alternative embodiments, the geometry of the T-shaped tabs can differ from the geometries shown in FIGS. 1 to 7. Likewise, T-shaped groove 6, which is disposed on top side 12 of peripheral flange 9, may have a different geometry. It is important that the T-shaped tabs of the tube bottom correspond to the T-shaped grooves of the cover in such a way that they assure a tight fit of the tabs in the grooves.

In alternative embodiments, the use of ribs on the outer surface of the cover can also be omitted. An optimal design is to be selected according to the intended use.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A heat exchanger comprising a heat exchanger block disposed between two collecting tanks, the heat exchanger comprising:

a collecting tank having a cover and a tube bottom, the tube bottom having upstanding edge regions; and T-shaped tabs disposed at an upper end of the upstanding edge regions, wherein the cover has a flange rear engageable at least in part by the T-shaped tabs, and wherein a top side of the flange of the cover has T-shaped grooves, which correspond to the T-shaped tabs of the tube bottom.

2. The heat exchanger according to claim 1, wherein the flange has a continuous outer surface, against which the inner surfaces of the upstanding edge regions of the tube bottom comes to lie.

3. The heat exchanger according to claim 1, wherein the T-shaped grooves of the flange have a bottom surface that is disposed at an angle in a range of 90° to 180° or in a range of 90° to 120° to a continuous outer surface of the flange.

4. The heat exchanger according to claim 1, wherein the T-shaped grooves of the flange are spaced apart by ribs running on an outer surface of the cover.

5. The heat exchanger according to claim 1, wherein upward projections are disposed on the top side of the flange, wherein the T-shaped tabs are configured to be bent in the flange of the cover so that the projections are rear engageable by long legs of the T-shaped tabs.

6. The heat exchanger according to claim 1, wherein a peripheral seal is disposed between the tube bottom and the cover.

* * * * *